United States Patent [19]

Ballman

[11] 4,326,589

[45] Apr. 27, 1982

[54] ANTI-FREEZE ARRANGEMENT FOR SPRINKLER SYSTEMS

[75] Inventor: Frederick C. Ballman, Fort Smith, Ark.

[73] Assignee: Baldor Electric Company, Fort Smith, Ark.

[21] Appl. No.: 38,481

[22] Filed: May 14, 1979

[51] Int. Cl.[3] ..... A62C 35/00

[52] U.S. Cl. ..... 169/5; 137/68 R

[58] Field of Search ..... 169/20, 54, 16, 18, 169/9, 5, 37, 90; 137/797, 68 R; 251/331; 220/89 R, 89 A

[56] References Cited

U.S. PATENT DOCUMENTS

| | | | |
|---|---|---|---|
| 1,246,798 | 11/1917 | Thompson | 169/16 |
| 1,404,827 | 1/1922 | Anderson | 169/5 |
| 1,686,221 | 10/1928 | Adams, Jr. | 169/5 |
| 2,505,456 | 4/1950 | Beecher | 137/68 R |
| 2,515,473 | 7/1950 | Rider | 169/5 |
| 2,678,799 | 5/1954 | St. Clair | 137/68 R |
| 3,059,702 | 10/1962 | Hebert | 169/37 |
| 3,257,026 | 6/1966 | Taylor | 220/89 A |
| 3,633,596 | 1/1972 | Gerber | 137/68 R |
| 3,709,239 | 1/1973 | Morck, Jr. | 137/68 R |
| 3,845,878 | 11/1974 | Carlson | 220/89 A |
| 4,056,116 | 11/1977 | Carter et al. | 137/68 R |

*Primary Examiner*—Robert J. Spar
*Assistant Examiner*—Kenneth Noland
*Attorney, Agent, or Firm*—Rogers, Eilers & Howell

[57] ABSTRACT

An antifreeze arrangement especially for automatic sprinkler systems comprising a frangible membrane, secured to a bellows interposed in the water supply pipe to the sprinkler system, antifreeze solution downstream of the membrane with water upstream thereof, the membrane being one that breaks out but does not separate from the bellows when a sprinkler relieves the pressure on the downstream side. Pressure equalizing piping connections, filling piping, and a specific gravity indicator are provided.

5 Claims, 1 Drawing Figure

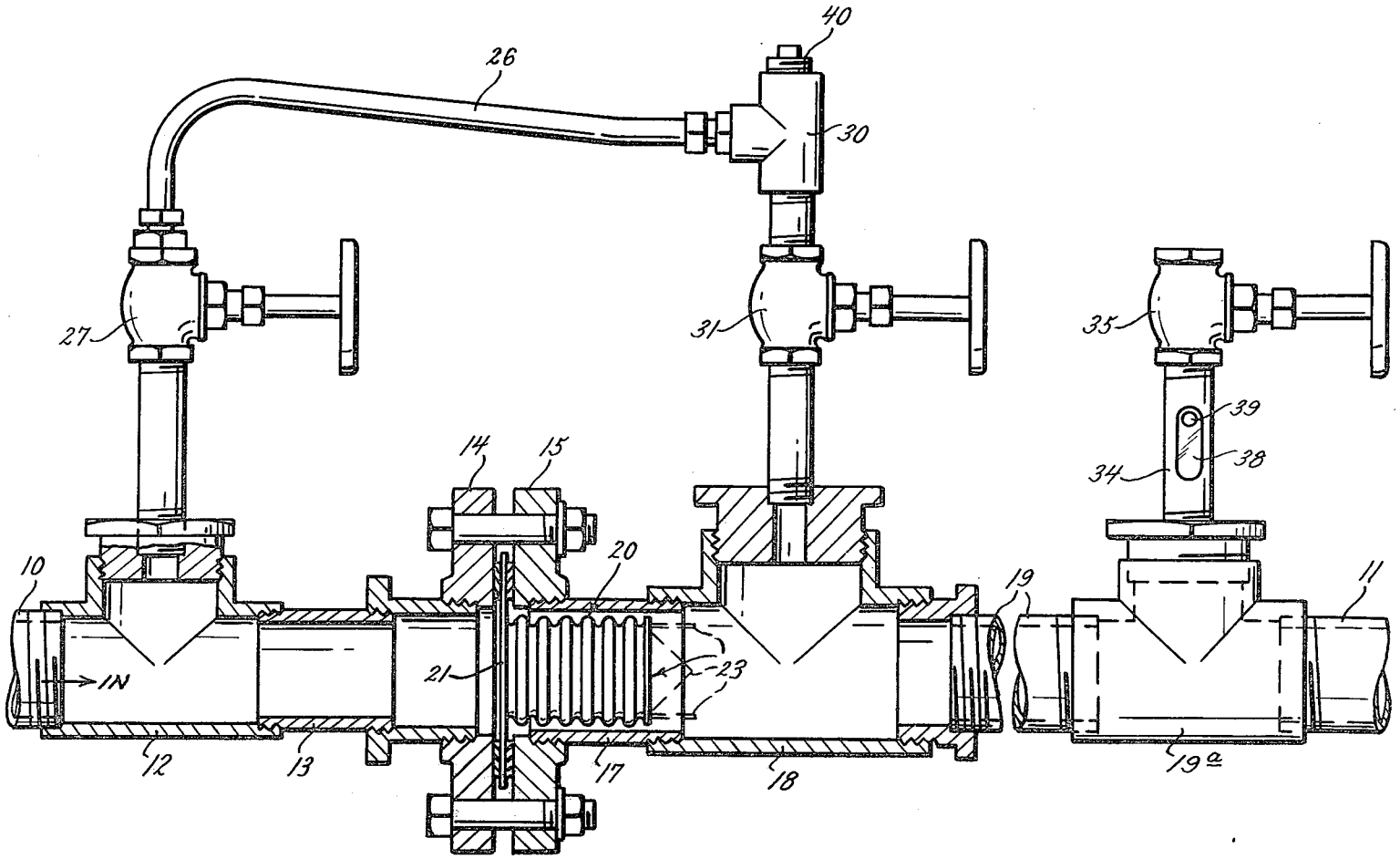
40
30
26
27
31
35
39
38
34
11
19a
19
18
23
20
15
14
21
17
13
12
10
IN

ANTI-FREEZE ARRANGEMENT FOR SPRINKLER SYSTEMS

BACKGROUND OF THE INVENTION

The present invention is especially useful in connection with automatic sprinkler systems in places where temperature changes are expected at which water will freeze. The system generally provides for a frangible membrane across the water supply pipe at the beginning of the portions of the system subject to freezing, with an antifreeze liquid downstream of the membrane. The frangible membrane is suitably mounted to one end of a bellows so that it can move freely to some degree without rupturing. Such movement is necessary in order to compensate for small, inevitable changes in solute volume.

Heretofore valves of one kind or another have been used to separate out the water from the antifreeze in systems of this kind.

Livingston U.S. Pat. No. 3,871,457 shows a fluid control device that obviously operates on a different principle from that here contemplated. Ryder U.S. Pat. No. 2,340,144 likewise has an arrangement that could be used in such context as the present device but also requires the operation of a valve. Other patents of a similar nature are U.S. Pat. Nos. 1,765,840, 945,956 and 953,260, which involve the presence of valves of one kind or another, all of which are subject to leaking or to becoming locked into one position or another by the presence of corrosion, fatigue or the like.

THE INVENTION AND ITS OBJECTIVES

In the present invention a frangible membrane, preferably attached to a bellows, is used to separate the end of the system having antifreeze in it from the water input. This means that the device is not subject to the vagaries of movable parts that must interrelate. Also in the present invention the bellows has a frangible tab or end on it, or some similar arrangement that not only permits the membrane to break, but does so without releasing the part that opens. It thereby is prevented from separating from the bellows and moving downstream where it may clog the system.

Objects of the invention also include the provision of means to equalize pressures on both sides of the membrane so that the membrane can assume a neutral position, and can accommodate changes in the volume of the piping because of temperature changes.

Another object of the present invention is to provide means to indicate the antifreeze capabilities of the downstream liquid.

DESCRIPTION OF THE DRAWING

The drawing is a view in longitudinal section of the present invention, parts being broken away.

DESCRIPTION OF THE PREFERRED EMBODIMENT

The present invention is intended to be used with automatic sprinkler systems wherein extensions having automatic sprinkler heads are subject to being frozen. Thus the system incorporates a water lead-in pipe 10 connected to a lead-out pipe 11. The latter extends on into the area which is subject to freezing temperatures and has one or more sprinkler outlets thereon of the familiar type adapted to open when heat or some other property indicates the need for water.

The pipe 10 is connected through several fittings, as will be described. The pipe 10 connects into a T 12, and thence into a nipple 13. The nipple 13 is secured to a collar and a flange 14 of a flanged connector, here indicated somewhat diagrammatically. The other flange 15 of the connector includes a short pipe fitting 17, that at its other end, is engaged into a T 18. The connector flanges 14 and 15 are releasably clamped together as by bolts. The other end of the T 18 receives a pipe 19. This pipe 19 may be a nipple in most cases. It connects into another T 19*a*, for a purpose to appear. The T 19*a* in turn receives the lead-out pipe 11.

A bellows 20, with a closed frangible end 23, of non-corrosive metal preferably, but in any case, of material that is flexible so that the bellows can expand and contract but frangible for purposes presently to appear, is mounted as illustrated. It has its base flange 21 clamped between the connector flanges 14 and 15 in a sealing manner. As noted, the connector is illustrated in somewhat diagrammatic form, it being known that various forms of connectors or unions are available and could be used. Some of them would involve a frusto-conical shape to the flange 21.

The bellows 20 has its accordion section extending within the short pipe or nipple 17. That pipe 17 has a somewhat enlarged inner diameter, so that a bellows may be inserted that has its inner diameter approximating that of the pipes 10 and 11. The end 23 of the bellows, either integrally or in a separate piece integrated with the bellows, is designed to break out one or more portions to permit fluid flow past the bellows, without having these portions break completely away from the bellows. Thus the inner end 23 of the bellows may be scored to provide break-out tabs, leaving unscored connection portions so that when pressure within the bellows breaks the membrane 23 outwardly downstream, it will merely bend the tabs over but the same will not be released. Until the tabs are broken out, there is no communication from the pipe 10 to the pipe 11 past the bellows. The break-out area should provide a passage as big as the pipes 10 and 11, so that full flow of fluid can be accommodated. Preferably these scores are in the form of diametrical lines terminating near the outer periphery of the membrane 23. This gives a maximum weakness at the center intersection. As illustrated, there are two score lines, but more may be provided, especially if it is desirable to reduce the restricted area when the tabs are open.

A bypass pipe 26 of small diameter is connected between the pipes 10 and 11 so that it can provide a bypass around the closed bellows. A valve 27 is located in this bypass 26 and can be operated to open or close the bypass. The bypass also has another valved inlet connection 30 controlled by a valve 31 and sealed with a removable plug 40. when the valve 27 is closed, the valve 31 is open an plug 40 removed, liquid or other fluid can be introduced into the pipe 11.

In order to let air escape from the pipe 11 as the other fluid is introduced through the inlet 30, there is an exhaust pipe 34 connected into the T 19*a*. It is controlled by a valve 35. The pipe 34 also has a window 38 in it closed by an appropriate transparent member. This pipe 34 is normally filled with the liquid. It contains an indicator ball 39 for a purpose to appear. The T 19*a* and associated parts may be connected at an appropriate place, presumably the highest place, in the pipe 11.

However, usually the pipe 19 can be a short nipple, so that the combination of the T 12 through the T 19*a*, and associated parts, may be pre-assembled and dispensed as a unit to be inserted into or installed with a sprinkler system.

In use, the parts are assembled as indicated in the drawings. The bellows 20 including the frangible membrane 23, is completely sealed between the members 14 and 15 of the union. It may actually be brazed, soldered or welded to one or the other of them, depending on the materials in question. But in any event it is completely sealed.

Thereafter, with the valve 27 closed, the valves 31 and 35 open, and plug 40 removed, antifreeze material, such as ethyleneglycol, calcium chloride, or other antifreeze material, is introduced into the downstream end of the system through the pipe 30. The open valve 35 lets air become displaced by the antifreeze.

When the system is entirely full of antifreeze downstream of bellows 20 and with pipes 30 and 34 completely filled with antifreeze soluton, then the valves 31 and 35 are closed, valve 27 is opened and plug 40 left removed. Now the main water valve (not shown) is opened and water is admitted to pipe 10. When pipe 10 has been completely filled and all air has been expelled through the bypass line and out the open vent, then the main valve will be shut off and the vent plug 40 will be replaced.

The next step will be to equalize pressures in pipes 10 and 11. This is accomplished by first placing valves 27 and 31 in the open position with the valve 35 closed. The main water valve is now opened so that the full water pressure is admitted to both pipes 10 and 11. Since all pipes are completely filled with the liquid, no water will actually flow into any of the lines. The restricted size of the bypass 26 prevents undue mixing of the upstream water with the downstream fluid. Pressure qualization should be carried out at temperature mean between the upper and lower anticipated temperature limits. With pressure equalization completed, all valves will be placed in the closed position. The ball float is checked for proper position (either up or down, depending upon the particular antifreeze solution used) and then the system is operational.

The bellows prevents premature breaking of the membrane due to initial excesses of the pressure on its opposite sides, until the pressures are equalized.

The ball float as described here is a simple and dependable device for indicating the proper specific gravity of the antifreeze solution. Other methods may be employed. A continuous monitor that will indicate the position of the ball can also be employed to ring a warning bell or light. Many types of these are also available and are based on photoelectricity, magnetism, conductivity, etc.

If with the setup as stated above a sprinkler head opens, the back pressure in the pipe 11 will immediately go down. The pressure differential on the two sides of the bellows then becomes great to the point that it first extends the bellows and then breaks out the membrane 23, letting the water through. The water can then flow freely to the sprinkler head.

In this operation the tabs of the membrane 23 are not separated from the membrane or from the bellows. This is important because if the tabs could separate, they could move downstream to a point where they could block the flow of water and interfere with the proper operation of the sprinkler system.

In the event a corrosive antifreeze material is used such as calcium chloride, corrosion-resistant materials must be used for the present system.

The system has been described in connection with the combination of water and an antifreeze liquid. It could be used with other materials including other liquids, a liquid to a gas, a gas to a liquid, or a gas to a gas.

A distinct advantage of the bellows is that it can accommodate changes in the volumes of the system based upon temperature changes such as those that would occur at the top of a warehouse where the sprinkler system may be located. The bellows has to have enough variable volume to take the temperature extremes of the particular system for which it is designed. Different sized bellows are therefore contemplated.

The system can be easily installed in an existing sprinkler system.

Various changes and modifications may be made within this invention as will be readily apparent to those skilled in the art. Such changes and modifications are within the scope and teaching of this invention as defined by the claims appended hereto.

What is claimed is:

1. In a system for separating fluids in a fluid system such as an automatic sprinkler, comprising: a fluid pipe for connection to a second fluid pipe subjected to a fluid under pressure, and for conducting fluid to an area subject to adverse physical conditions; a flexible, frangible membrane across the pipe sealing the entrance thereof; means to admit fluid to the pipe to fill it downstream of the membrane with a first fluid not affected adversely by the adverse physical condition; means for connecting the pipe to the second fluid pipe for introduction of a second pressure fluid on the upstream side of the membrane; the membrane being frangible upon application of the upstream fluid pressure thereto and release of the fluid pressure downstream thereof, the membrane being a flexible bellows, the end of the bellows having a weakened tab that can be broken out upon release of the downstream pressure, but the tab having an unweakened portion that holds it onto the bellows; a bypass pipe from the second pipe to the first one around the bellows; a valve controlling the bypass; a fluid inlet into the first pipe and a valve controlling it; an exhaust opening into the pipe downstream of the bellows, and a valve controlling the exhaust; and an indicator for the fluid in the pipe downstream of the bellows.

2. In a system of claim 1: an exhaust outlet pipe in the conductor downstream of the membrane; and valve means controlling it, so that where a fluid is introduced downstream of the membrane, gas already in the pipe may be exhausted, the indicator being in the exhaust outlet pipe.

3. In the system of claim 1, the interior dimension of the bellows and the area opened by the frangible portion of the membrane being at least substantially as large as the size of the pipe, whereby the membrane does not throttle flow when it opens.

4. In a system for separating liquids in arrangements such as sprinkler systems and the like: a lead-in pipe connected to a lead-out pipe; a volume-compensating rupture disk device comprising an expansible and contractible separating member interposed between the lead-in pipe and the lead-out pipe to separate liquids in the lead-in pipe from liquids in the lead-out pipe; the liquid in the lead-in pipe filling the same, normally engaging the lead-in side of the expansible-contractible member, and being subjected to pressure, and the liquid in the lead-out pipe being normally confined within the said pipe, normally engaging the lead-out side of the expansible-contractible member, and being subject to relatively small pressure changes in physical condition in the lead-out side; means to release the liquid in the lead-out pipe, and create thereby a large pressure difference between the liquid in the lead-in and lead-out pipes, the member having a frangible portion subjected on opposite sides to the lead-in and lead-out pressures, and of a strength to cause it to break out in response to such large pressure differences between the pressure in the lead-in pipe side of the member and the pressure in the lead-out side when the release means releases the liquid in the lead-out side, the member being expansible and contractible to accommodate the aforesaid lesser pressure differences of the liquid without breaking, and to maintain pressure on the liquid in the lead-out pipe at all times; and valved filler means to admit the liquid into the lead-out side.

5. In the system of claim 4: the separating member being a bellows, the frangible membrane comprising an end wall weakened so as to break upon occurrence of said excess pressure difference.

* * * * *